US006413315B1

(12) United States Patent
Hendricks

(10) Patent No.: US 6,413,315 B1
(45) Date of Patent: Jul. 2, 2002

(54) AUTOMATED ADJUSTABLE GLUING APPARATUS FOR A PACKAGING MACHINE

(75) Inventor: Timothy Hendricks, Acworth, GA (US)

(73) Assignee: Riverwood International Corporation, Atlanta, GA (US)

( * ) Notice: Subject to any disclaimer, the term of this patent is extended or adjusted under 35 U.S.C. 154(b) by 0 days.

(21) Appl. No.: 09/518,440

(22) Filed: Mar. 2, 2000

(51) Int. Cl.[7] ..... B05C 1/00; B65B 7/00

(52) U.S. Cl. ..... 118/222; 118/323; 53/376.5

(58) Field of Search ..... 118/209, 216, 118/221, 222, 680, 681, 323, 324; 156/578; 53/373.3, 374, 376.5; 493/128, 130, 131

(56) References Cited

U.S. PATENT DOCUMENTS

| | | | | |
|---|---|---|---|---|
| 3,218,216 A | | 11/1965 | Stephens et al. | 156/362 |
| 3,382,530 A | | 5/1968 | Glesner | 18/4 |
| 3,981,123 A | * | 9/1976 | Flanagan | 53/374 |
| 4,087,303 A | | 5/1978 | Strzalka | 156/357 |
| 4,589,943 A | * | 5/1986 | Kimball et al. | 156/256 |
| 4,781,786 A | * | 11/1988 | Lerner et al. | 156/468 |
| 5,027,976 A | | 7/1991 | Scholl et al. | 222/1 |
| 5,830,297 A | * | 11/1998 | Nakahira et al. | 156/64 |
| 5,875,922 A | | 3/1999 | Chastine et al. | 222/1 |
| 6,012,503 A | * | 1/2000 | Balder | 156/578 |

* cited by examiner

*Primary Examiner*—Richard Crispino
*Assistant Examiner*—Yewebdar T Tadesse
(74) *Attorney, Agent, or Firm*—Womble Carlyle Sandridge & Rice, PLLC

(57) ABSTRACT

An automated adjustable apparatus for dispensing glue includes a glue head assembly and an automated adjustment mechanism connected to the glue head assembly for adjusting the height of the glue head assembly to one of a plurality of predetermined heights corresponding to various heights of carton configurations within a article grouping and packaging machine. The adjustment mechanism may include a first servomechanism such as a pneumatic cylinder for moving the glue dispensing head into a plurality of predetermined height positions. The apparatus may include at least two glue dispensing heads on the service side of the machine into glue dispensing heads on the operations side of the machine and each independently controlled by actuation devices. Advantages include the elimination of manual adjustment on both the service and operations side of the machine to decrease changeover times. Additionally, the actuation device reduces the part number count over the prior art thus reducing component costs and maintenance costs.

18 Claims, 3 Drawing Sheets

AUTOMATED ADJUSTABLE GLUING APPARATUS FOR A PACKAGING MACHINE

FIELD OF THE INVENTION

The present invention relates, generally, to packaging machines. More particularly, the present invention relates to devices for applying glue to cartons on a packaging machine.

BACKGROUND OF THE INVENTION

A common type of packaging machine processes a large volume of individual articles by arranging and grouping the articles, loading a group of articles into a carton, closing and sealing the cartons, and dispensing the loaded cartons to an area where they are consolidated for shipping. A typical carton is constructed of paperboard or corrugated paper and has flaps, which are folded, closed and sealed with glue.

The state of the art includes various devices for applying glue to cartons on a packaging machine. A common type of glue used to seal paperboard cartons is a hot-melt material. The glue is heated in a central container and pumped to individual dispensing stations. The dispensing stations and hoses between dispensing stations and the central container often are also heated to keep the glue at the proper viscosity for dispensing. Devices on the dispensing stations have at least one nozzle, and often have a plurality of nozzles through which the glue is applied to flaps of cartons or cartons as the cartons pass by the dispensing station.

Prior art devices for applying glue to cartons are believed to have significant limitations and shortcomings. The devices are often custom-made wherein the nozzles are in a fixed predetermined location. A custom-made device may be relative expensive. As carton size changes for different articles or different group configurations, the position of the flaps typically changes thereby requiring a change in the position of the nozzles on the dispensing station. A glue dispensing station on a packaging machine typically has a number of custom-made devices, each with different nozzle configuration for a specific carton configuration run on the machine. An inventory of several custom-made devices or a dispensing station is relatively expensive.

When a changeover is made on the packaging machine to run a different carton, one glue dispensing device is removed and another is installed. Such an operation can be time consuming and risk damage to the devices. The devices are hot from the glue, and care must be taken personnel are not burned when removing a device. The devices may be allowed to cool before removing, which takes time. Hoses between the glue supply and dispensing devices must be disconnected and reattached either to the devices or the to glue supply. This risks damage to the hoses each time a connection is changed. Air may also be undesirably introduced into the system by the new hose connection. The new hose and hoses must be heated to the working temperature before operation of the machine can be resumed, which increases changeover time. Such devices may be rather bulky, requiring a space of one or two linear feet of the packaging machine. On a packaging machine where space is limited, this basic requirement may be too much.

Other prior art gluing systems for packaging machine utilize a glue dispensing head attached to a clamping block that is moved in a vertical direction along a bar by a rack and pinion gear arrangement. In this prior art device, the bar has the rack teeth, and the pinion gear and attached pinion shaft are supported by the clamping block. The clamping block has an aperture receiving the bar. In this embodiment, an operator may turn an adjustment knob connected to the pinion shaft, which adjusts the vertical position of the clamping block and glue dispensing head relative to the bar. Rotation of the pinion shaft is selectively allowed or prevented by a locking knob threadably engaged with the pinion shaft. The clamping block is further secured to the bar by a screw in the clamping block which contacts the back side of the bar to provide a teeth engagement adjustment for the rack and pinion gear teeth by rotating the adjustment knob the glue head maybe raised and lowered. Disadvantages of this adjustment mechanism include a requirement of locating the rack and pinion or screw jack assembly on the front or operation side and rear or service side of the machine. This rack and pinion device requires adjustment not only on the operation side but also on the service side of the machine. Disadvantages of this glue had adjustment configuration include difficulty of adjustment on the service side of the machine due to lack of room for an operator. This arrangement increases changeover time. Additionally, the rack and pinion arrangement may not accommodate an accurate adjustment of the height which leaves the glue heads at a height which is out of specification. Additionally, the rack and pinion device includes a high number of parts arranged in a very complex manner. This arrangement therefore increases the likelihood of malfunction and increases the costs of the overall machine. Finally, due to the rather bulky nature of the rack and pinion apparatus, there is a significant likelihood that components of the adjustment apparatus or gluing mechanism may interfere with other stations or components on the packaging machine and become bound with one another causing damage to the machine.

Applicant's invention overcomes the limitations and shortcomings of the prior art by providing an apparatus which utilizes a plurality of small, standard glue dispensing devices attached to automated adjustment mechanisms on the operation and service side of the machine. The apparatus and dispensing devices are cost effective.

SUMMARY OF THE INVENTION

The present invention relates to an automated adjustable apparatus for dispensing glue. The apparatus may include a glue head assembly for dispensing glue and an automated adjustment mechanism connected to the glue head assembly for adjusting a height of the glue head assembly to one of a plurality of predetermined heights. Each of the predetermined corresponds to heights of various carton configurations that receive glue for the purpose of gluing flaps to the carton.

In one embodiment of the present invention, the adjustment mechanism may include at least one servomechanism having a first end connected to a frame on a packaging machine and a second end connected to the glue head assembly. Although the servomechanism may comprise a number of devices, Applicant has found that automatically actuated cylinders having a predetermined number of extension positions work very well with the present invention. In other embodiments of the present invention, the assembly may include first and second glue heads wherein the first glue head is a position above the second glue head by predetermined separation distance. In the preferred embodiment of the present invention the adjustment mechanism is arranged and configured to increase the predetermined separation distance between the first and second glue heads with increasing overall assembly height adjustments. This feature allows for a greater distance between applied glue portions to accommodate greater distances between flaps on larger cartons.

In the preferred embodiment, the adjustment mechanism for the gluing apparatus may include a horizontally orientated servomechanism anchor bar that can support any number of servomechanisms connected to each one of the glue heads within the assembly. For example, in the preferred embodiment of the present invention, the adjustment mechanism includes a first servomechanism having a first end connected to the first glue head and a second end connected to the servomechanism anchor bar. The adjustment mechanism may also include a second servomechanism having a first end connected to a second glue head and a second end connected to the servomechanism anchor bar. In this embodiment, the first and second servomechanisms may independently position the first and second glue heads, respectively, to one of a plurality of predetermined heights to accommodate cartons of varying height.

In an alternative embodiment to the present invention, the assembly may include a third servomechanism connected between a relatively fixed point and a servomechanism anchor bar. The third servomechanism may be arranged and configured to extend the servomechanism anchor bar to one of a plurality of predetermined positions. In this alternative embodiment a total number of glue head positions would be equal to the product of the number of third servomechanism positions and the number of predetermined positions of the first or second servomechanisms.

The present invention includes many improvements over the prior art. First, the servomechanisms used in accordance with the present invention automatically move to one of a number of predetermined positions depending upon carton sizes. Thus, changeover time is significantly reduced because an operator need not adjust mechanisms on both the service and control side of the packaging machine. Additionally, since each one of the glue heights are predetermined automatically, an operator need not spend time attempting to adjust the glue head height to the proper specified position, which further reduces changeover time. Additionally, the servomechanisms used in connection with the present invention significantly reduced the part count associated with glue head height adjustment, thus, reducing overall cost of the packaging machine.

These and other features of the present invention will become apparent upon reading the following specification, when taken in conjunction with the accompanying drawings.

DETAILED DESCRIPTION OF THE INVENTION

Figure 1:
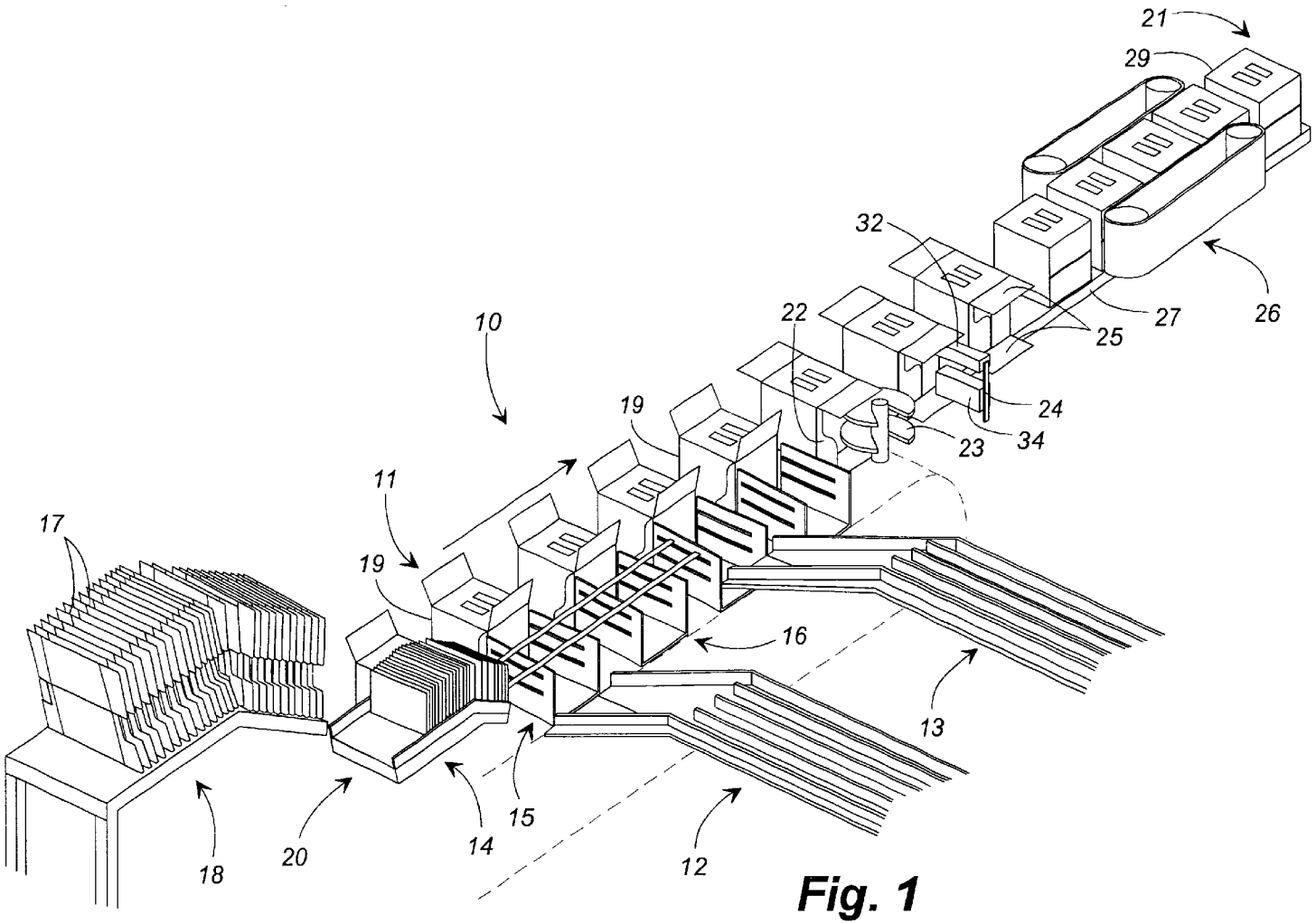
FIG. 1 is a perspective view schematically illustrating a packaging machine on which a gluing apparatus of the present invention can be used.

Referring to FIG. 1, an example of a packaging machine 10 is schematically shown to illustrate the relation of a gluing apparatus to other portions of the machine and the packaging process. While the packaging machine 10 shown is used to package a stacked group of beverage containers into a paperboard carton, the invention is applicable to any packaging machine configuration which uses glue to secure carton flaps, or for other purposes.

Example packaging machine 10 has a carton stream or line 11, a lower article supply stream or line 12, a second or high article supply stream or line 13, a divider sheet feeder 14, and a grouping container line 15 having a plurality of grouping containers 16. Carton line 11 takes carton blanks 17 to a carton blank magazine 18, opens them into cartons 19 and conveys cartons 19 longitudinally on conveyor 27 from an upstream end 20 of the machine to a downstream in output end 21. Grouping containers 16 run parallel and adjacent to open cartons 19 for a plurality of the carton line 11. Carton line 11 in grouping container line 15 move intermittently. When grouping containers 16 are in proper alignment with article supply lines 12 and 13, articles (not shown) flow along article supply lines 12 and 13 into grouping containers 16. Divider sheet feeder 14 supplies a divider sheet on top of the lower articles received from article supply line 12 to facilitate upper articles from article supply line 13 sliding over the lower articles in grouping container 16. Grouped articles are loaded from grouping container 16 into open cartons 19 then inner flaps 22 are closed by a flap closing apparatus 23, glue is applied to the inner flaps 23 by a gluing apparatus 24, and outer flaps 25 are closed by another closing apparatus (not shown). The closed cartons then pass through a compression section 26 which holds the flaps closed while the glue sets. The completed package 29 is then discharged at the output end of the machine.

Figure 2:
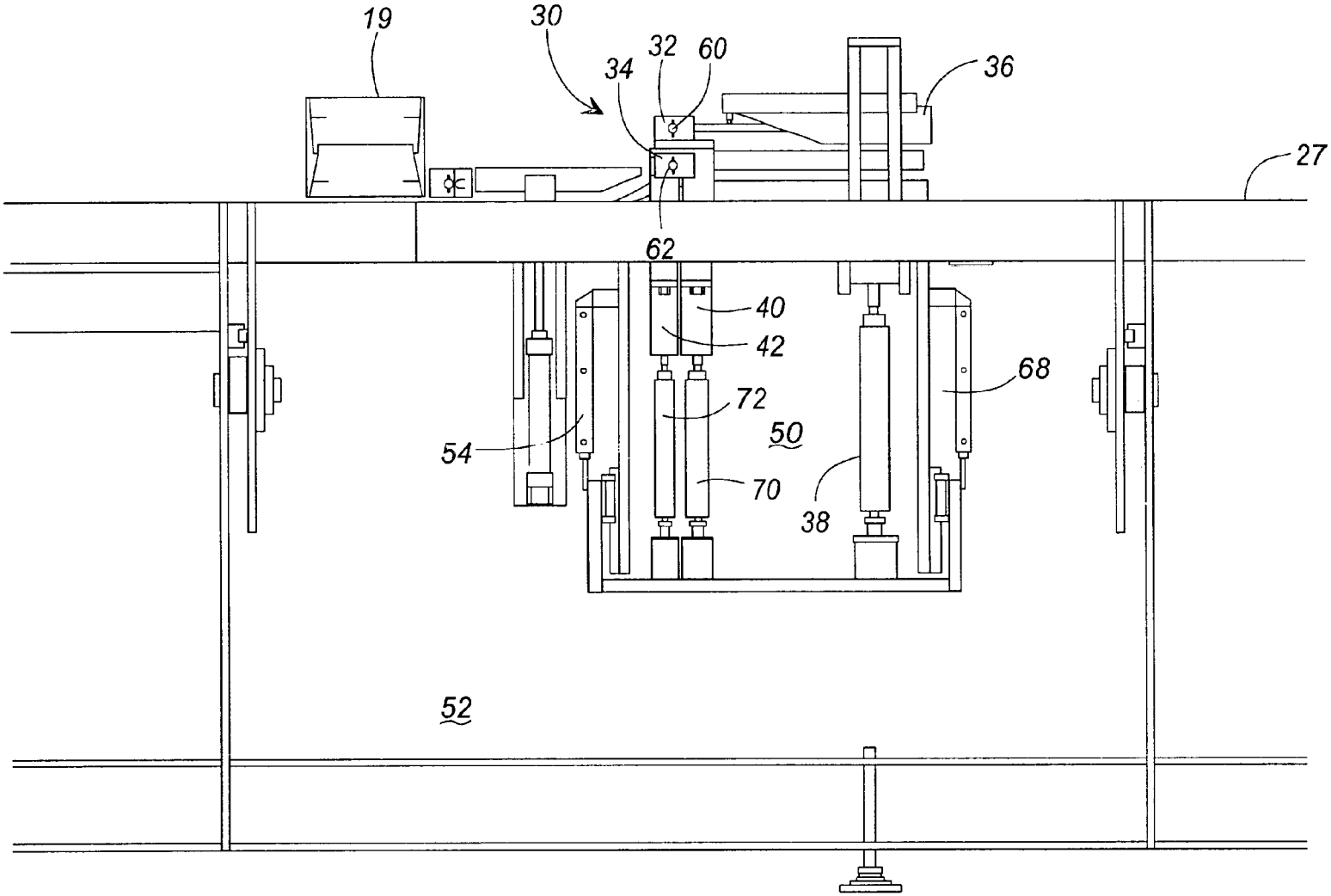
FIG. 2 is a front view of a portion of a packaging machine illustrating the glue head adjustment apparatus in accordance with the present invention.
Figure 3C:
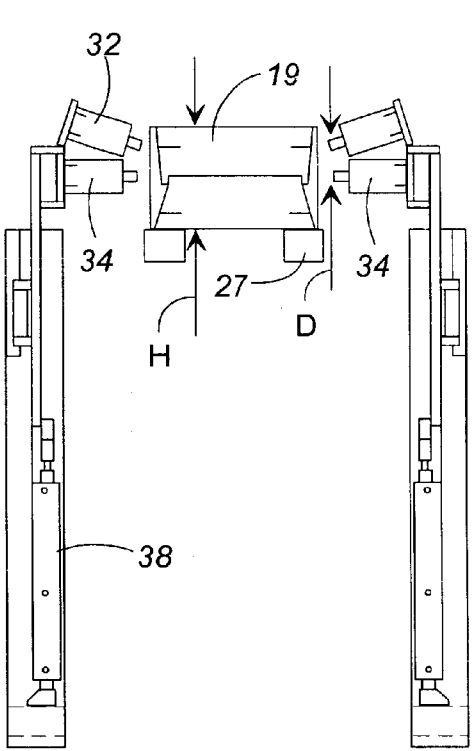
FIG. 3 is a front view of the various positions of glue heads disposed on a service side of a packaging machine in accordance with the present invention.
Figure 3B:
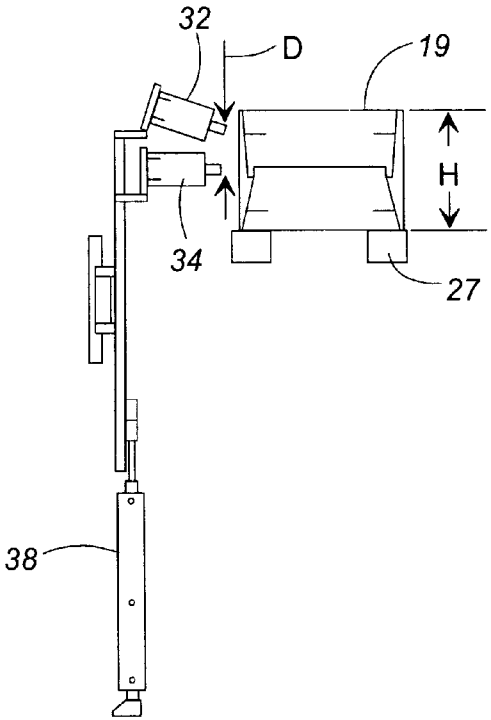
Figure 3A:
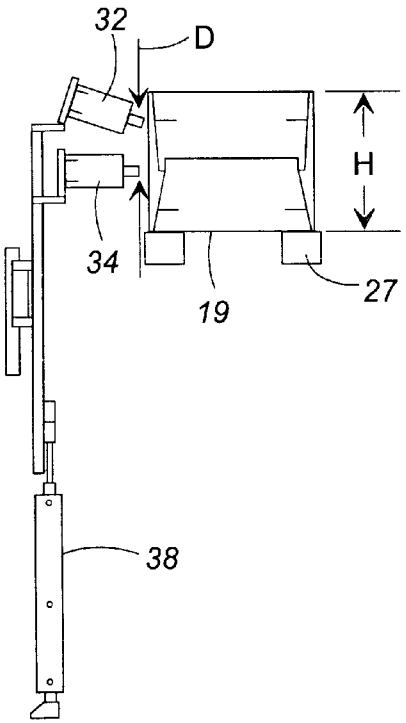

Referring to FIGS. 2 and 3, the gluing apparatus includes upper and lower glue heads 32 and 34, respectively. Typically, the dispensing glue head may comprise a compact model H202 manufactured by Nordson Corporation. The glue heads have input hoses (not shown) communicatively connected to a central source of hot glue (not shown) into the various dispensing heads 32 and 34. Hot-melt glue is pumped from the central source through a hose to the dispensing heads where it is dispensed through at least one discharge nozzles, such as nozzles 60 and 62. Each dispensing glue head may include any number of dispensing nozzles necessary to apply an appropriate amount of glue to the carton flap to achieve proper adhesion between inner and outer carton flaps. In the aforementioned manner, the glue is dispensed from the nozzles 60 and 62 on to flaps 22 of a loaded carton 19 traveling on the conveyor 27. Upper glue dispensing head 32 is connected to pneumatic cylinder 70 through mechanical link 40. Similarly, lower glue dispensing head 34 is connected by a mechanical link 42 to pneumatic cylinder 72. Each of cylinders 70 and 72 are connected at their lower ends to a cylinder mechanism anchor bar 44. Pneumatic cylinders 70 and 72 position the upper and lower glue dispensing heads 32 and 34 depending upon the carton height. Although many different types of cylinder mechanisms may serve well to position the upper and lower glue dispensing heads, Applicant has found that pneumatically controlled multiple-position pneumatic cylinders work quiet well in the preferred embodiment of the present invention for several reasons. First, the pneumatic cylinders are commercially available and may be utilized to adjust the glue heads to one of a plurality of preset positions. Second, pneumatic actuation is preferred over other types of actuators such as hydraulic cylinders and or stepper motors due to the cleanliness of operation and simplicity of operation. The attributes of cleanliness and simplicity of operation require less maintenance, and thus lower operating costs for the machine. Examples of multiple-position pneumatic cylinders suitable for use in the present are available from Mimba Manufacturing Company of Monee, Ill. 60449-0068.

Depending upon the height of the carton 19, the cylinders 70 and 72 may automatically position the glue dispensing heads based on predetermined carton heights. Downstream of the glue dispensing heads 32 and 34 is a static closing plow 66 which forces the flaps into a closed position for a final securement as is described above. Additionally, a closing plow actuator 38 is linked to the closing plow 66 through mechanical link 64. In a manner similar to the pneumatically actuated cylinder 70 and 72, closing plow actuator 38 may comprise a pneumatic cylinder having a number of predetermined extension links which correspond to a plurality of carton heights. Thus, in operation the carton 19 progresses downstream as is shown in FIG. 1, passes the flap closing apparatus 23 to close the inner flaps 22, receives the glue from glue heads 34 and 32 and passes through static closing plow 66 to close the outer flaps 25 onto inner flaps 22 prior to entering the compression section 26.

In an alternative embodiment of the present invention, a third multiple-position pneumatic cylinder or actuator 68 may be linked between the frame of the machine and the servomechanism anchor bar 44. In this embodiment, the third pneumatic cylinder 68 may increase the number of possible positions for the glue dispensing heads 32 and 34. For example, the number of possible height positions for glue heads 32 and 34 is multiplied by the number of possible extension positions of pneumatic cylinder 68 to comprise the total number of height adjustments for the glue dispensing heads 32 and 34. For example, if cylinders 70 and 72 each have three preset extension positions and cylinder 68 also has three preset cylinder positions, then the total number of preset height positions for the glue dispensing heads 32 and 34 would be nine, since three positions of cylinders 70 and 72 exist for every one position of cylinder 68.

FIGS. 3(*a*), 3(*b*), and 3(*c*) illustrate the separation distance between glue dispensing heads 34 and 32 as a function of the height of carton 19. FIG. 3(*a*) illustrates the largest carton having the highest carton height H. In this particular position glue dispensing heads 32 and 34 are separated by a distance D. The distance D sufficiently separates separate extrusions of hot-melt glue so as to cover sufficient portions of the inner flap 22 to receive both upper and lower outer flaps 25, as is shown in the expanded view of the carton in a downstream position in FIG. 1. As the carton height decreases, as is shown in FIG. 3(*b*), the distance D also decreases to accommodate a lessening distance between respective glue extrusions required to glue both the upper and lower outer flaps 25 to inner flaps 22. Finally, FIG. 3(*c*) illustrates the closest distance D between the upper and lower glue dispensing heads 34 for the smallest dimension H for the smallest carton, which will pass through the machine. Thus, for an increased height setting, the distance D between the glue dispensing heads 32 and 34 may increase. Referring back to FIG. 2, a distance between relative extension positions for cylinder 70 must be greater than that of cylinder 72 for such a varying separation distance configuration.

While preferred embodiments have been illustrated and described above, it is recognized that variations may be made with respect to features and components of the invention. Therefore, while the invention has been disclosed in preferred forms only, it will be obvious to those skilled in the art that many additions, deletions and modifications can be made therein without departing from the spirit and scope of this invention, and that no undue limits should be imposed thereon except as set forth in the following claims. For example, the means of actuating the glue dispensing heads may include stepper motors or hydraulic cylinders. Additionally, the inventive glue dispensing apparatus may dispense any type of glue which is sufficient to fasten various flaps of paperboard or corrugated cardboard cartons to one another. Finally, the ordinarily skilled artisan will understand that pneumatic cylinders utilized in accordance with the present invention may include any number predetermined preset extension lengths or positions depending upon the number of carton height configurations that are required.

What is claimed is:

1. An adjustable apparatus for dispensing glue, comprising:

a glue head assembly for dispensing glue comprising first and second glue heads, wherein said first glue head is positioned above said second glue head by a predetermined separation distance; and an automated adjustment mechanism connected to said glue head assembly for adjusting a height of said glue head assembly to one of a plurality of predetermined heights, wherein said predetermined heights correspond to heights of objects to receive glue.

2. The gluing apparatus of claim 1 wherein said adjustment mechanism comprises:

at least one servomechanism having a first end connected to a frame on the packaging machine and a second end connected to said glue head assembly.

3. The gluing apparatus of claim 2 wherein said servomechanism comprises:

at least one pneumatically actuated cylinder.

4. The gluing apparatus of claim 1 wherein:

said adjustment mechanism is arranged and configured to increase said predetermined separation distance with increasing object height.

5. The gluing apparatus of claim 4 wherein said adjustment mechanism further comprises:

a servomechanism.

6. The gluing apparatus of claim 4 wherein said adjustment mechanism further comprises:

at least one pneumatically actuated cylinder.

7. The gluing apparatus of claim 4 wherein said adjustment mechanism further comprises:

a servomechanism anchor bar;

a first servomechanism having a first end connected to said first glue head and a second end connected to said servomechanism anchor bar; and a second servomechanism having a first end connected to said second glue head and a second end connected to said servomechanism anchor bar;

wherein said first and second servomechanisms independently position the first and second glue heads, respectively, to said plurality of predetermined heights.

8. The gluing apparatus of claim 7 wherein:

said first and second servomechanisms are arranged and configured such that a distance between successive height positions of said first glue head is greater than a distance between successive height positions of said second glue head to create said increase in said predetermined separation distance between said first and second glue heads with increasing glue assembly height.

9. The gluing apparatus of claim 7, further comprising:

a third servomechanism connected between a relatively fixed point and said servomechanism anchor bar, said third servomechanism being arranged and configured to extend to move said servomechanism anchor bar to a plurality of predetermined positions; whereby a total number of predetermined glue head positions is equal to the product of the number of third servomechanism positions and the number of predetermined positions of the first and second servomechanisms.

10. In an article packaging machine for packaging groups of articles into cartons on a conveyor, a vertically adjustable gluing apparatus for dispensing hot-melt glue onto portions of cartons moving in a downstream direction on the conveyor, the gluing apparatus comprising:

a glue head assembly for dispensing glue onto cartons for gluing carton flaps to portions of the cartons, said glue head assembly comprising first and second glue heads, wherein said first glue head dispenses glue onto an upper portion of each carton for attaching a first carton flap to each carton and wherein said second glue head dispenses glue onto a lower portion of each carton for attaching a second carton flap to each carton, wherein said first glue head is positioned above said second glue head by a predetermined separation distance; and an automated adjustment mechanism connected to said glue head assembly for adjusting a height of said glue head assembly to one of a plurality of predetermined heights, wherein said predetermined heights correspond to heights of a plurality of carton types.

11. The gluing apparatus of claim 10, wherein said adjustment mechanism comprises:

at least one servomechanism having a first end connected to a frame on the packaging machine and a second end connected to said glue head assembly.

12. The gluing apparatus of claim 11 wherein said servomechanism comprises:

at least one pneumatically actuated cylinder.

13. The gluing apparatus of claim 10 wherein:

said adjustment mechanism is arranged and configured to increase said predetermined separation distance between said first and second glue heads with increasing carton height to accommodate increasing distance between relative glue areas for cartons of increasing height.

14. The gluing apparatus of claim 13 wherein said adjustment mechanism further comprises:

a servomechanism.

15. The gluing apparatus of claim 13 wherein said adjustment mechanism further comprises:

at least one pneumatically actuated cylinder.

16. The gluing apparatus of claim 13 wherein said adjustment mechanism further comprises:

a servomechanism anchor bar attached to the packaging machine frame;

a first servomechanism having a first end connected to said first glue head and a second end connected to said servomechanism anchor bar; and a second servomechanism having a first end connect to said second glue head and a second end connected to said servomechanism anchor bar;

wherein said first and second servomechanisms independently position the first and second glue heads, respectively, to a plurality of predetermined heights to accommodate different heights of a plurality of carton types.

17. The gluing apparatus of claim 16 wherein:

said first and second servomechanisms are arranged and configured such that the distance between successive height positions of said first servomechanism is greater than the distance between successive height positions of said second servomechanism to create said increase in predetermined separation distance between said first and second glue heads with increasing carton height.

18. The gluing apparatus of claim 16, further comprising:

a third servomechanism connected between a relatively fixed point and said servomechanism anchor bar, said third servomechanism being arranged and configured to extend to move said servomechanism anchor bar to a plurality of predetermined positions; whereby a total number of predetermined glue head positions is equal to the product of the number of third servomechanism positions and the number of predetermined positions of the first and second servomechanisms.

* * * * *